United States Patent [19]

Janniello

[11] 4,345,122

[45] Aug. 17, 1982

[54] DETACHABLE CORD

[75] Inventor: Frank Janniello, Stamford, Conn.

[73] Assignee: Clairol Incorporated, New York, N.Y.

[21] Appl. No.: 258,063

[22] Filed: Apr. 27, 1981

[51] Int. Cl.[3] ..... H01H 9/20

[52] U.S. Cl. ..... 200/50 B

[58] Field of Search ..... 200/51 R, 51.09, 51.1, 200/50 B

[56] References Cited

U.S. PATENT DOCUMENTS 621,860 3/1899 Shork ..... 200/51 R 1,612,711 12/1926 Erikson ..... 200/51.09

1,924,691 8/1933 Lofgren ..... 200/50 B 2,015,543 9/1935 Bissell ..... 200/50 B

*Primary Examiner*—John W. Shepperd

*Attorney, Agent, or Firm*—Isaac Jarkovsky; John J. Balser; Gerald S. Rosen

[57] ABSTRACT

There is disclosed an electric cord mechanical interlock system which prevents the user from removing or inserting the cord of an electric appliance when the appliance is switched on thus preventing arcing across the contacts. Arcing is prevented by providing an extension as part of the on-off switch control which, when the switch is off, engages and raises a flexible arm containing a pin, allowing the plug to be inserted or removed.

2 Claims, 2 Drawing Figures

DETACHABLE CORD

BACKGROUND

This invention relates to a mechanical interlock system used in conjunction with a detachable alternating current (AC) cord which is capable of handling high current needed for electric powered appliances such as drills, saws, irons, hair curling irons, heaters, and the like. The mechanical interlock system prevents arcing between contacts.

Arcing can occur between contacts of a plug and socket of an electric appliance when the plug is removed from the socket while the appliance is turned on. This arcing tends to burn the terminals. In addition, arcing can be a fire hazard.

Several mechanical devices have been developed which attempt to solve the arcing problem. These devices are satisfactory, however, they are complex and uneconomical.

Knickerboker, U.S. Pat. No. 1,727,347, issued Sept. 10, 1929 discloses a plug which incorporates a switch that must be in the "off" position before the plug can be connected to or disconnected from an appliance. A locking pin which is part of the switch and plug combination engages an aperture in the wall of the socket.

Hartwig, U.S. Pat. No. 1,731,417, issued Oct. 15, 1929 discloses a unit in which a flexible arm with a pin for engaging the cord plug is actuated by a switch through a bell crank lever and a pin or rod having a spring.

Wulle, U.S. Pat. No. 1,818,290, issued Aug. 11, 1931 discloses a unit having a rocker latch operating through a linkage to a rotary switch. The connecting rod of the linkage abuts a cam type locking surface such that when the switch is on, the rod is retracted allowing the latch to engage a recess in the plug, preventing removal of the plug.

Parish, U.S. Pat. No. 2,705,266, issued Mar. 29, 1955 discloses a switch and receptacle unit in which a lever on the outside of the switch casing is activated by a linkage system to operate an enclosed switch and, at the same time, cause a locking pin to engage a recess in the plug when it is inserted into the receptacle, preventing removal of the plug while the switch is on. In addition, another lock mechanism prevents rotation of the linkage attached to the switch making it impossible to turn the switch on unless a plug is in the receptacle.

Concannon, U.S. Pat. No. 3,372,367, issued Mar. 5, 1968 discloses a single pin plug device in which rotation of a switch operates a cam shaft causing contacts to connect into the plug. A pin on the contact strip inserts into a receptacle on the plug, locking the plug into the socket.

Knecht, U.S. Pat. No. 4,054,762, issued Oct. 18, 1977 discloses a mechanism which locks a plug into a socket when a switch is on. A rotating sleeve around the socket for a grounding pin of the plug contains an L-shaped slot into which a key lug on the grounding pin will fit when the sleeve is properly aligned. Only when the switch is off will the slot in the sleeve and a corresponding slot in the receptacle allow removal or insertion of the plug into the socket by securing the key lug in the L position of the slot.

None of the references disclose a simple, economically constructed plug and switch mechanism as provided by this invention which prevents arcing wherein a flexible bar with a pin on it is displaced by an on-off switch extension so that when the switch is in the off position, a plug with a recess in it for receiving the pin can be inserted or removed and when the switch is in the on position, the plug cannot be removed or inserted because the pin either holds the plug or blocks it.

It is an object of this invention to provide an economical, structurally simple, connector interlock system which prevents arcing.

BRIEF SUMMARY OF THE INVENTION

This invention provides a detachable AC cord mechanical interlock system which insures that an electric powered device is turned off before the cord is inserted or removed, thus preventing arcing. The system is comprised of two essential parts, the male plug on an AC cord and the on-off switch in the appliance electrically connected to the female socket in the appliance.

The female socket contains an electrical contact for receiving and electrically contacting the male plug contact element. Connected to the socket is an on-off switch with a sliding control such as a thumb button. The switch has an "on" position and an "off" position and can have any number of intermediate positions. Illustrated for purposes of simplicity is a switch with a low power position and a high power position. Extending across the top of the switch is a cover plate having stops between which the on-off control can slide longitudinally relative to the female socket. The sliding motion is controlled by a thumb button. An extension of the cover plate is in the female socket, on the inner surface of the socket. A flexible bar with a pin projecting toward the center of the socket is on the surface of the extension which faces away from the inner surface of the socket. The sliding member has an extension with a wedge shaped end reaching into the socket longitudinally in the direction of the flexible bar. When the switch is turned off, the extension is displaced toward the flexible bar and the wedge end lifts the flexible bar, moving the pin in a radial direction away from the center of the socket. This allows the plug on the power cord to be inserted into the socket. When the switch is moved to an "on" position, the extension is moved longitudinally toward the rear of the socket and away from the flexible bar releasing it and allowing it to return to its original position, causing the pin to drop into an indentation in the insulation of the plug, locking the plug into the socket.

The plug on the power cord is comprised of insulation around electric contact members attached to power carrying wires. The contact members protrude from the plug and when inserted into the socket of the appliance, contact the female electrical contacts therein.

DETAILED DESCRIPTION OF THE INVENTION

Figure 1:
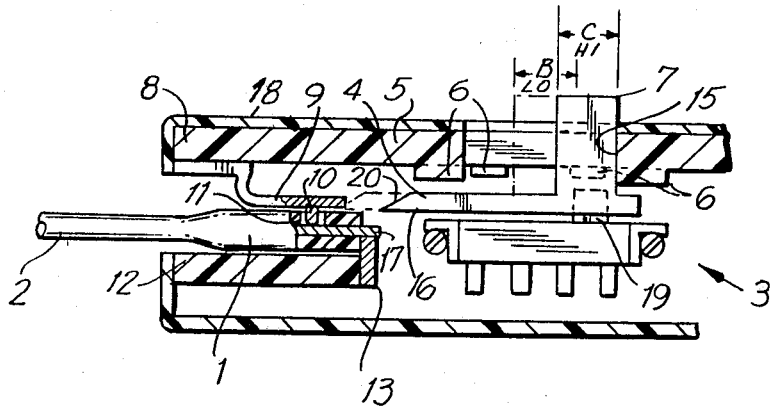
FIG. 1 is a sketch of a side view of the plug and mechanical interlock system of this invention in an "on" position.
Figure 2:
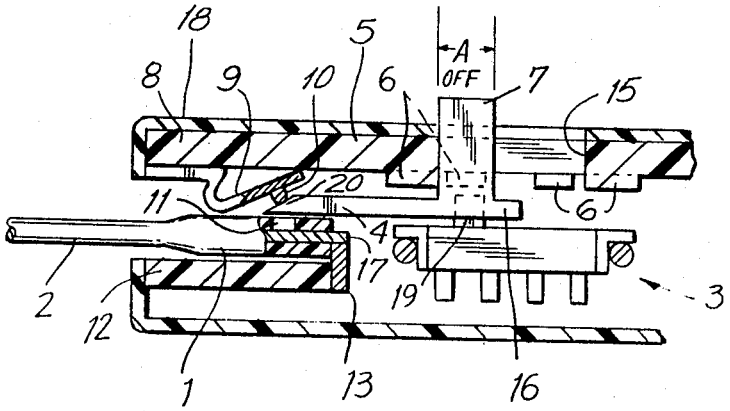
FIG. 2 is a sketch of a side view of the plug and mechanical interlock system of this invention in the "off" position.

The embodiment of the invention as illustrated by FIGS. 1 and 2 has a female socket 12 which is part of the appliance housing 18 and contains electric contacts 13 which are electrically attached by conventional wiring, not shown, to a three position power switch 3 in the housing, said power switch 3 has a sliding control member 16 attached thereto which extends longitudinally into the female socket 12. A cover plate 5 on the power switch 3 has an extension 8 which extends longitudinally into the socket 12. The extension 8 has on its surface toward the inside longitudinal axis of the socket 12 a strip of spring metal 9 biased radially toward the center of the socket 12. At the end of the spring metal strip 9 toward the back of the socket 12 is a pin 10 on the face of the strip 9 which faces the longitudinal axis of the socket 12.

The switch cover plate 5 has a longitudinal opening 15 for accommodating the thumb button control 7 which is attached to the top of the sliding control member 16. There are bosses 6 on the underside of the switch cover plate 5 at each control position in the cover plate 5 which act as stops to stop the thumb button 7 from moving too far when it is pushed longitudinally toward or away from the socket 12 and thus control the current. In FIGS. 1 and 2 there is a boss 6 at position A, the "off" position, position B, the "low" position, and position C, the "high" position; the bosses 6 for position B are shown in dotted lines since they are at the side of the opening 15.

The sliding control member 16 is slidably attached to the switch 3 by a boss 19 projecting from the switch 3 into a longitudinal groove or track on the underside of the sliding control member. An extension 4 of the sliding control member 16 extends longitudinally toward the socket 12, and has a wedge shaped end 20. When the sliding control member 16 is moved longitudinally to the "off" position A, the end 20 of the extension 4 slides under and radially lifts the spring metal strip 9 with the pin 10 toward the inside surface of the socket 12 away from the longitudinal axis thereof. This enables a male plug to either be inserted or removed.

The male plug 1 which is used in this invention comprises electrical contacts 17 connected to an alternating current power cord 2. The connection is insulated with elastomeric insulation formed to have an indentation 11 situated so that it can receive the pin 10 of the spring metal bar 9 when inserted into the socket 12. The electrical contacts 17 protrude from the insulated plug 1 and contact the electrical contacts 13 in the socket 12 when inserted therein.

The plug 1 can receive the pin 10 only when the sliding control member 16 is in an "on" position, since it is in the "on" position that the spring metal bar 9 is released from the lifting pressure of the slide extension 4 and can lock the plug into position.

As can be seen from FIGS. 1 and 2, the plug 1 can only be inserted into or removed from the socket 12 when the sliding control member 16 is in the "off" position. When in an "on" position, the pin 10 will block the plug 1 from entering the socket 12 or from being removed from the socket 12. Since it is possible to remove or insert the plug into the socket 12 only when the appliance is off, no arcing can occur as happens when a plug can be removed when an appliance is turned on.

I claim:

1. A mechanical interlock system for use with a detachable electric cord for preventing arcing between the contacts comprising:

a female socket, in an electrically powered device requiring high current, said socket having therein female electrical contacts for receiving male electrical contacts of a detachable plug and having on the inside wall thereof a strip of spring metal biased toward the center of the socket, said spring metal having a pin on the surface thereof facing toward the longitudinal axis of the socket;

a switch in said electrically powered device having a sliding control member having a longitudinal extension with respect to said socket which extends into said socket adapted to lift the spring metal radially away from said axis of the socket when the sliding control member is in the "off" position longitudinally toward the front of said socket and to release the spring metal strip when the sliding control member is in an "on" position in a direction longitudinally toward the rear of the socket; a plug with male electrical contacts insertable into said socket to make electrical contact with said female electrical contacts, said plug having a groove in its insulation for receiving said pin on the spring metal strip when said plug is in said socket and said sliding control member is in an "on" position, locking the socket in place, wherein said plug can be inserted or removed from said socket only when the sliding control member is in the "off" position.

2. The mechanical interlock system of claim 1 wherein the switch is a three position switch.

* * * * *